US007357861B2

(12) United States Patent
Kelley et al.

(10) Patent No.: US 7,357,861 B2
(45) Date of Patent: Apr. 15, 2008

(54) CURB INLET FILTER

(75) Inventors: David K. Kelley, Midlothian, VA (US); Gene M. Diloreto, Richmond, VA (US); Craig S. Wyler, Winchester, VA (US)

(73) Assignee: ACF Environmental, Richmond, VA (US)

( * ) Notice: Subject to any disclaimer, the term of this patent is extended or adjusted under 35 U.S.C. 154(b) by 27 days.

(21) Appl. No.: 11/258,145

(22) Filed: Oct. 26, 2005

(65) Prior Publication Data

US 2007/0090033 A1 Apr. 26, 2007

(51) Int. Cl.
*E03F 5/06* (2006.01)

(52) U.S. Cl. ..... 210/162; 210/163; 210/473; 404/4

(58) Field of Classification Search ..... 210/162, 210/163, 164, 470, 473, 483, 486, 495; 404/4, 404/5

See application file for complete search history.

(56) References Cited

U.S. PATENT DOCUMENTS 2,374,755 A * 5/1945 Kisch ..... 210/486
2,693,246 A * 11/1954 Marcheck ..... 210/486
5,632,888 A * 5/1997 Chinn et al. ..... 210/163
6,214,216 B1 * 4/2001 Isaacson ..... 210/163
6,217,756 B1 * 4/2001 Martinez ..... 210/163
6,274,036 B1 * 8/2001 Ellis ..... 210/164
6,692,637 B2 * 2/2004 Fox et al. ..... 210/486
6,709,579 B1 * 3/2004 Singleton et al. ..... 210/163
7,179,371 B1 * 2/2007 Bistline ..... 210/163
2003/0173277 A1 * 9/2003 Shaw et al. ..... 210/163
2004/0016692 A1 * 1/2004 Sasaki et al. ..... 210/473
2004/0112811 A1 * 6/2004 Lindemulder ..... 210/163

* cited by examiner

*Primary Examiner*—Christopher Upton
(74) *Attorney, Agent, or Firm*—Westerman, Hattori, Daniels & Adrian, LLP.

(57) ABSTRACT

A curb inlet filter for filtering out sediments and the like flowing into a curb inlet, includes a filter body, including a water permeable, substantially rigid, elongated frame having an upstream side and a downstream side thereof, and an elongated filter cover formed around at least one of the sides of the frame. The filter cover is formed of a filtration material to filter out sediments and the like. Further, a weight support attached to a bottom of said filter body for supporting a weight, and a support strap connects the weight support to an upper portion of the filter body.

21 Claims, 14 Drawing Sheets

CURB INLET FILTER

FIELD OF THE INVENTION

The instant invention is directed to a curb inlet filter, and more particularly to a curb inlet filter for filtering out sediments and the like flowing into a curb inlet.

RELATED ART

Ground water from heavy rains or melted snow is normally collected in a storm sewer or in a curb inlet and then flows into an underground storm sewer line. Water flows into the basin through openings in a grate on top of the basin, or into a curb inlet through an opening along the vertical portion of the curb.

It is important that water entering a sewer line should be free of suspended solids, such as sediments, debris or the like. If stormwater, for example, flows into a curb inlet, in a construction site where soil has been disturbed, a great deal of sediment or other solids (including debris) may flow into the curb inlet and thus, into the storm sewer lines. When too much sediment or solid materials flow into the storm sewer lines, they become clogged.

Accordingly, in the past, numerous products have been used to prevent sediment or other solids from flowing into curb inlet storm drains. Products such as straw wattles have been used to filter out sediment and other solids flowing into a curb inlet storm drain. Hay bails have also been used to filter out sediment and other solids from stormwater flowing into a curb inlet. Additionally, stones have been wrapped in chicken wire and placed in front of a curb inlet type storm drain. The straw wattle and hay bail type of sediment filters often get clogged and are often not reusable. Also, they may decompose and slip into the storm drain. This could cause further clogging. Furthermore, the method using stones and chicken wire (stone bundles) does not filter out as large amount of sediment and other solids as do other methods. Also, these stone bundles break and fall into the drains, and can also be a safety hazard for children.

SUMMARY OF THE INVENTION

The instant invention is a curb inlet filter for filtering out sediments, solids and the like flowing into a curb inlet type of storm drain. Generally, the term sediment, when used in connection in this application refers to solid particles that are suspended in water flowing into a curb inlet. Sediment may originate from earth, grass, and other sources, and any other type of material suspended in water flowing into a curb inlet. Generally, a curb inlet refers to an opening in a vertical face of a curb (with or without a grade level storm sewer catch basin with a grating on top) which leads to a drain unit that directs stormwater into a storm sewer. While focused on use with a curb inlet type of drain, the instant invention may also be used with a combination type of drain which joins a curb inlet drain with a catch basin type of drain with a horizontal grate.

The instant invention includes a frame and a filter cover formed on at least part of the frame. For example, such types of curb inlet filters are often used in and around construction sites where earthen materials have been moved around and under heavy rains become sediment suspended in runoff water. As the runoff water (with sediment or the like suspended therein) flow into a curb inlet type of storm drain, the instant invention covers the mouth of the curb inlet and filters out many of the sediment or solid particles suspended in the stormwater.

A curb inlet filter, in accordance with the instant invention, is provided for filtering out sediments, solids and the like flowing into a curb inlet. The curb inlet filter has a filter body which includes a water permeable, substantially rigid, elongated frame having an upstream side and a downstream side thereof, and an elongated filter cover formed around at least one of the sides of the frame, wherein the filter cover is formed of a filtration material to filter out sediments and the like. Additionally, the curb inlet filter includes a weight support attached to the bottom of the filter body for supporting a weight, and a support strap connecting the weight support to an upper portion of the filter body. The support strap helps to pull the top of the filter body snug with the top of the curb inlet. It is contemplated that the weight support can be attached rigidly or flexibly to the filer body. It is then possible that the support straps could be connected to different portions of the filer body, rather than just the upper portion, although the upper portion is preferable. It is also possible that there are no support straps. For example, a weight support may be attached more rigidly to filter body, so that support straps are not necessary.

Additionally, the curb inlet filter may include a plurality of spacers, wherein at least one spacer is formed at each end of the frame. Spacers are formed on the downstream side thereof, in order to form a gap between the spacers and the downstream side of the frame. This allows the water to flow over the top of the frame, through the gap formed between the spacers, and into the curb inlet.

The filter cover of the filter body preferably entirely surrounds the frame. However, it is possible to mount the filter cover on only one side of the frame. While the filter cover is preferably a woven fabric, it may also be formed of a non-woven material. This non-woven material could be a mat-type material, or it may be some type of metal grill or other type of filter. The preferred woven fabric is multidimensional, and even more preferably a three dimensional fabric. A preferable fabric is Pyramat® manufactured by SI Geosolutions. For the same size of frame, a three dimension fabric has a larger surface area than a conventional two dimensional fabric. Accordingly, a filter using a three dimensional fabric will be able to filter more sediment than a conventional two dimensional fabric. Another reason a three-dimensional fabric is preferable is that flowing water tends to bounce off of a two-dimensional fabric easier than a three-dimensional fabric. Additionally, when the filter cover entirely surrounds the frame, in envelop fashion, it presents two surfaces for filtering, one on the upstream side and one on the downstream side of the frame.

The weight support may be removably attached or fixedly attached to a bottom portion of the filter body. In other words, it may be located in a lower area of the filter body for pulling the filter snug against the curb. More specifically, the weight support may be removably attached to a bottom portion of the filter body by using connectors to make the connection. Furthermore, the weight support may be a bag for receiving a weight therein. When in use, it is easy for the user to put a portion of a steel or other type of weight in the bag. Additionally, the bag may be waterproof with a closable filling hole therein. A user could simply fill the bag with water and close the filing hole in order to provide the weight for the curb inlet filter.

The filter cover may be formed of a cylindrical sleeve, into which the frame is axially inserted, wherein the sleeve is closed up at opposing ends thereof. Alternately, the filter cover may have a closeable seem running along a longitudinal side thereof. The frame may be inserted into the filter cover and the seam simply closed up. Any other appropriate arrangement for covering the sleeve is also appropriate.

The frame may be a single unit, or it may be made of a plurality of individual units attached together. They may be permanently attached at they may be detachably attached to one another. Using a plurality of individual elements, the frame may be built up in modules for use with different sized curb inlets. Also, when a frame is composed of a plurality of individual elements (each one shorter than the total length of the frame) the frame may be broken down for easier shipping. Preferably, each of the individual elements of the frame would include one or more spacers. A frame element, whether it is one or a plurality of elements, may also be formed to be snapped together for easy assembly. Thus, the frame elements could be interlocking with one another. For example, each end of a frame element may have a dovetail or other equivalent type joint. In other words, one end of the frame would have a dovetail projection, and the opposite end of the frame element would have a dovetail recess, such that a frame may be formed of the plurality of individual elements in which the dovetail portions are nested with one another. Also, a key/keyway combination (or any other conventional means) may be used to join individual frame elements together.

The frame may also be a collapsible type of frame. The plurality of individual elements may be connected together by hinges, or the like, to provide an easily collapsible frame for ready transportation. Additionally, the frame may have a telescoping structure that makes for easy storage or shipping when in a collapsed state.

Additionally, the frame (whether a single unit or a plurality of individual elements) may also include a flexible insert formed on a bottom portion thereof, in order to adjust to the contours of the road surface on which the filter sets. The flexible insert may simply be a type of foam or foam rubber formed on the bottom of the frame. Additionally, the flexible insert may be an extruded rubber insert of any type which is fixed to the bottom of the frame or inserted into a groove or keyway.

For ease of transporting, a handle may also be formed on an upper portion of the curb inlet filter. Tieback straps may also be formed on the upper portion of the filter body in order to stabilize the curb inlet filter when in position in front of a curb inlet.

Furthermore, the curb inlet filter according to the instant invention may include an additional layer to absorb metals, oils and other containments. For example a coconut mat or organic layer may be added to absorb contaminants or other undesirable substances.

Also, the curb inlet according to the instant invention is easy to clean and reuse. It may simply be washed off and repositioned for subsequent use. As such, it provides great labor savings for a user, such as a contractor. It is reusable and, may be easily replaced if damaged. The frame may be easily replaced if it is damaged, while retaining the filer cover. Conversely, if the filter cover is damaged, it may easily be replaced while retaining the frame.

BRIEF DESCRIPTION OF THE DRAWINGS

The advantages of the invention will become apparent in the following description taken in conjunction with the drawings, wherein.

DETAILED DESCRIPTION OF THE INVENTION

Figure 1:
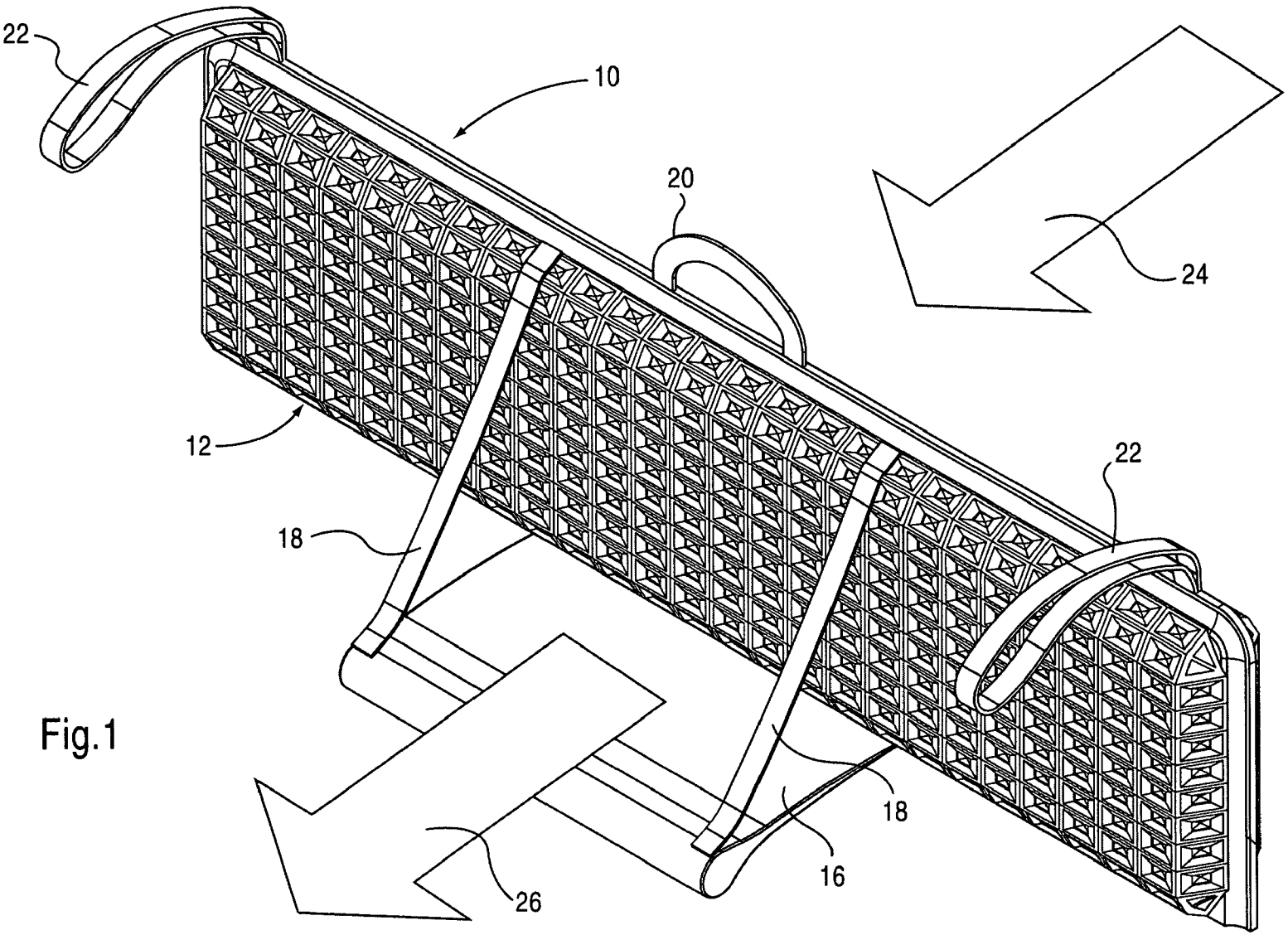
FIG. 1 is a perspective view of a downstream side of the curb inlet filter in accordance with the instant invention.
Figure 2A:
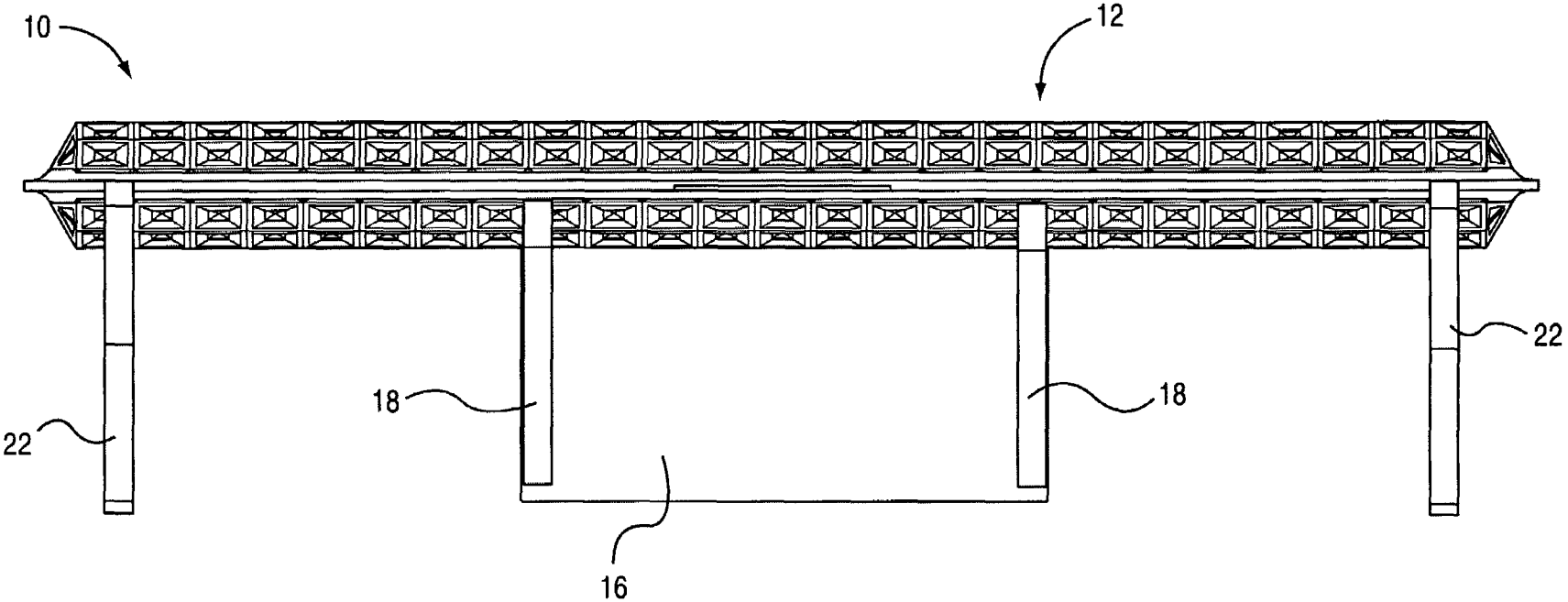
FIGS. 2(*a*)-2(*c*) are views of a curb inlet filter.
Figure 2B:
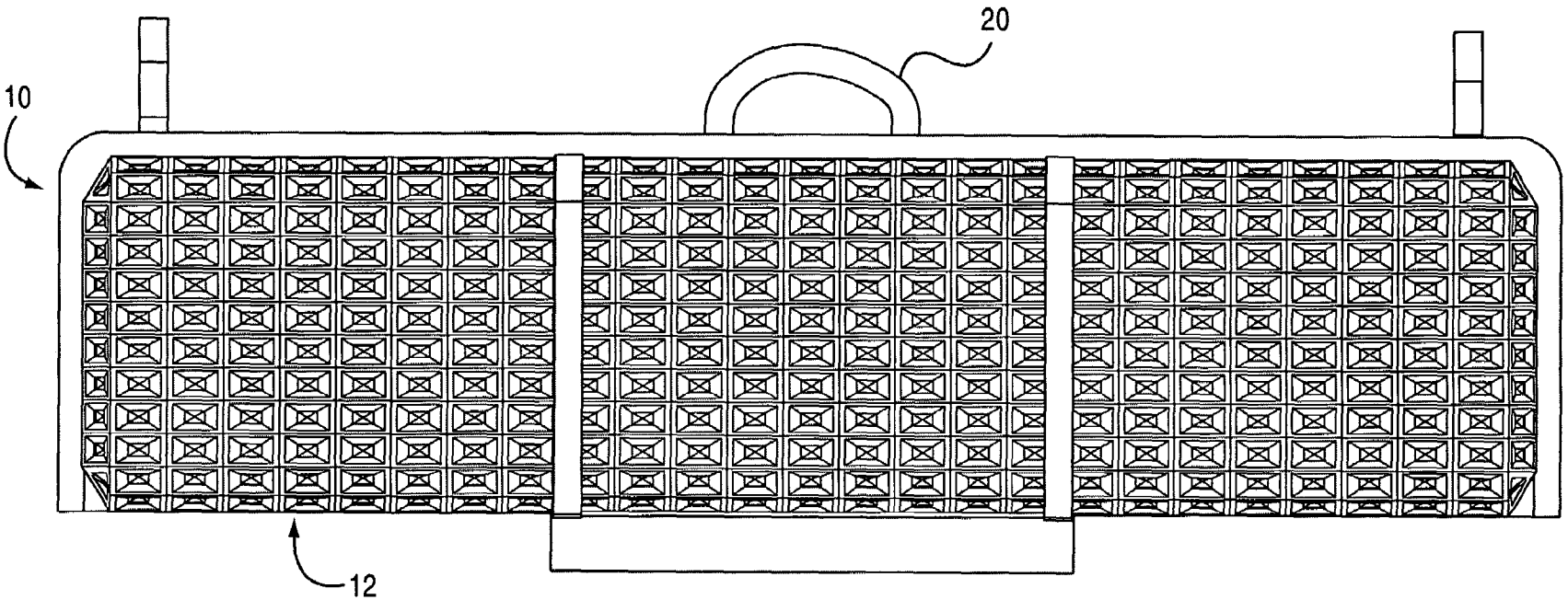
Figure 2C:
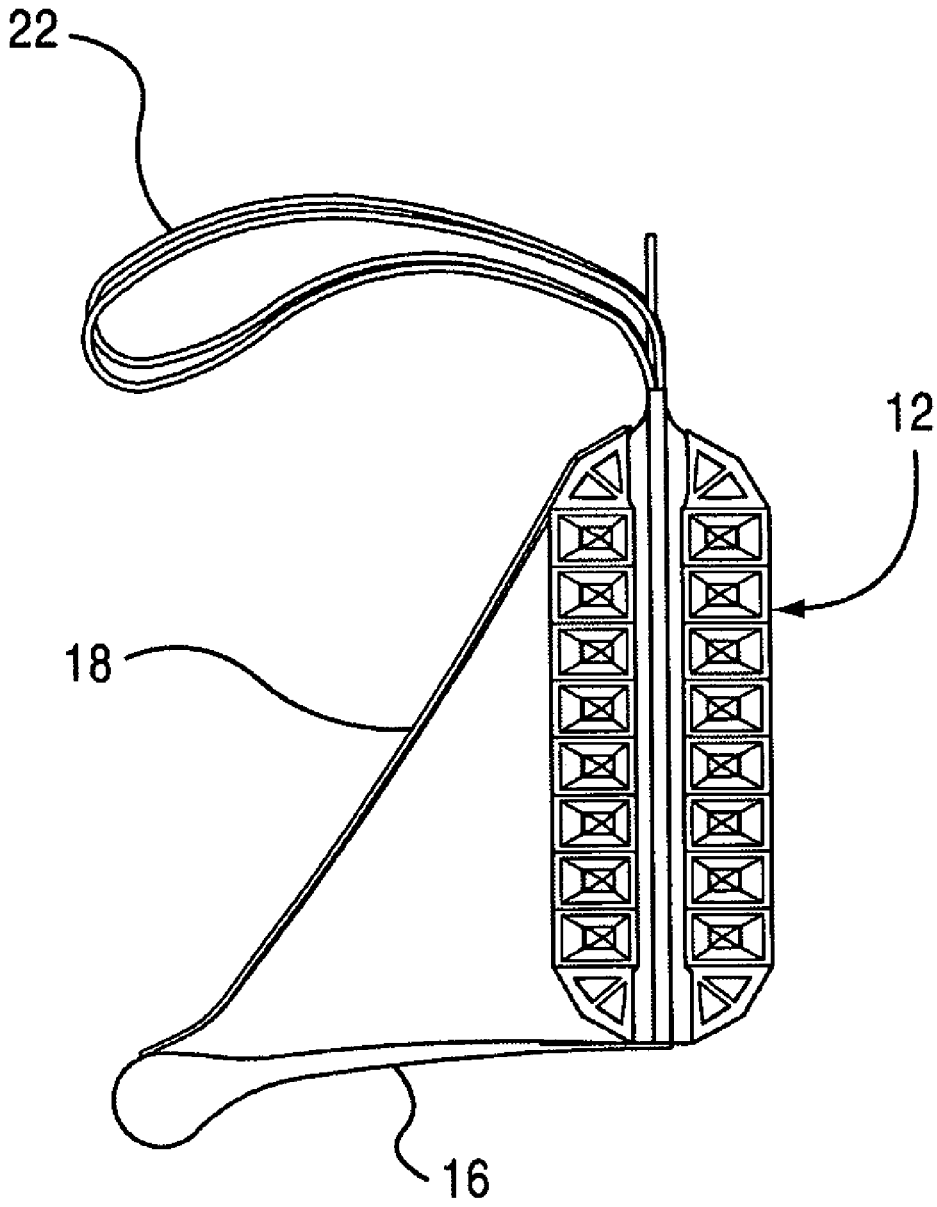

FIG. 1 is a perspective view of a downstream side of the curb inlet filter in accordance with the instant invention. FIGS. 2(*a*)-2(*c*) are additional views of the stormwater filer. As illustrated in FIGS. 1 and 2, curb inlet filter 10 includes a filter body 12, a weight support 16, and support straps 18. A handle 20 is attached to the top of filter body 12 for ease of transportation from one location to another. Tieback straps 22 may or may not be used. They may be used to tie the upper portion of filter body 12 back to keep it snug with the curb inlet. Arrow 24 represents the inflow of water toward the curb inlet filter 10. Arrow 26 represents the outflow of water after it has passed through stormwater filter 10. Accordingly, arrow 24 represents the upstream side of curb inlet filter 10, while arrow 26 represents the downstream side of curb inlet filter 10.

Figure 3:
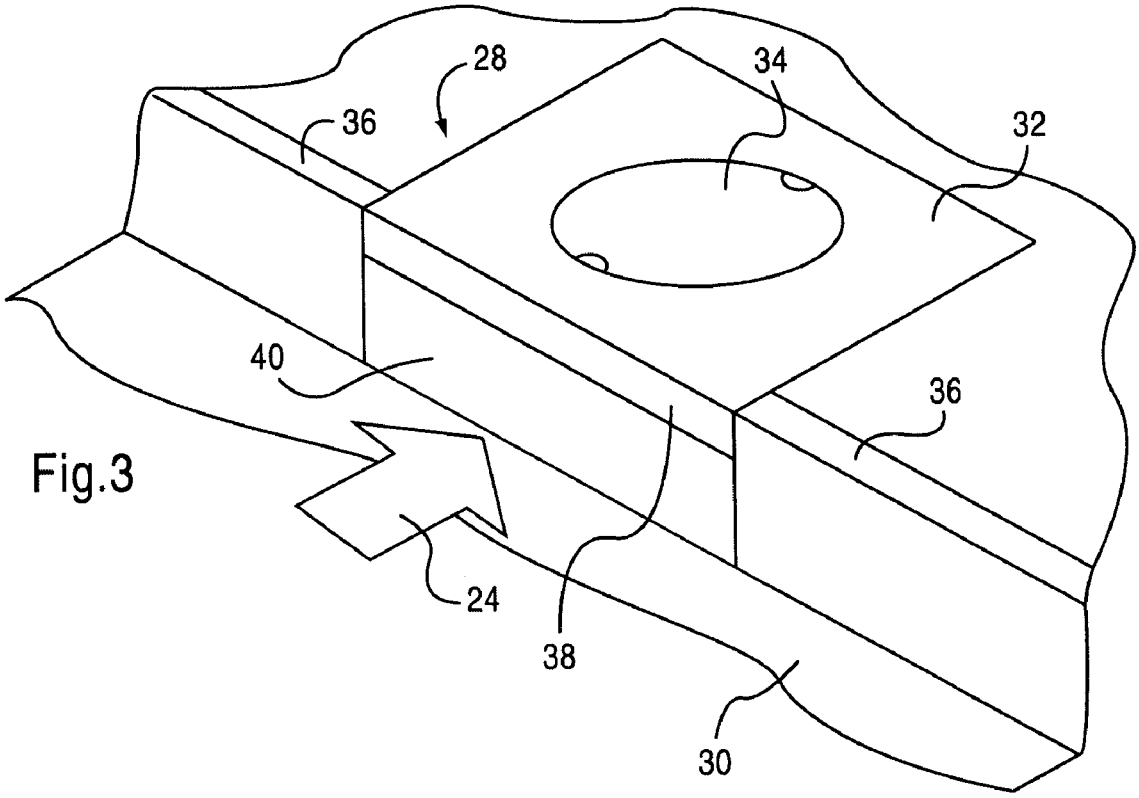
FIG. 3 is a perspective view of a curb inlet.

FIG. 3 is a perspective view of a typical curb inlet. Specifically, curb inlet 28 is formed in a curb 36, adjacent a road surface 30. Normally, such curb inlets have a top portion 32 with a manhole (or access) cover 34 located therein, in order to provide access to the drain below. A curb inlet opening 40 provides a passage for the inflow of water, represented by arrow 24, into the storm drain itself.

Figure 4:
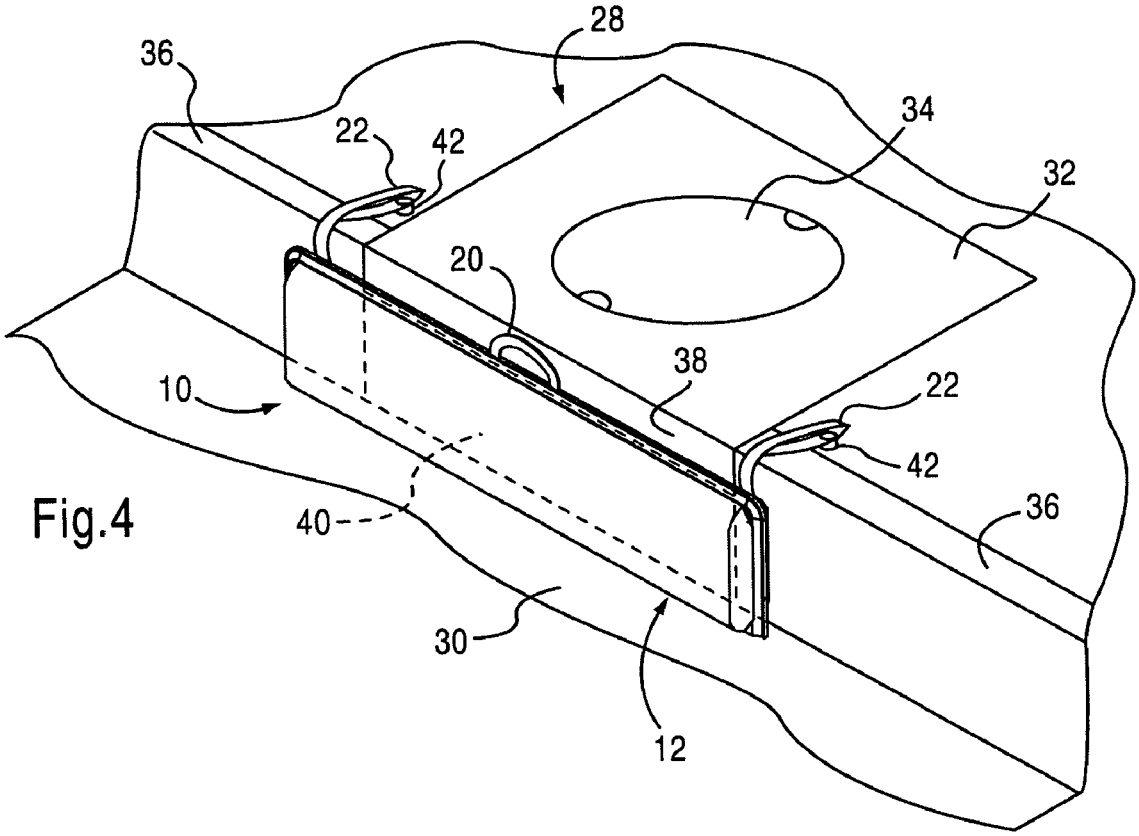
FIG. 4 is a perspective view of the curb inlet of FIG. 3, with the curb inlet filter in position.
Figure 5:
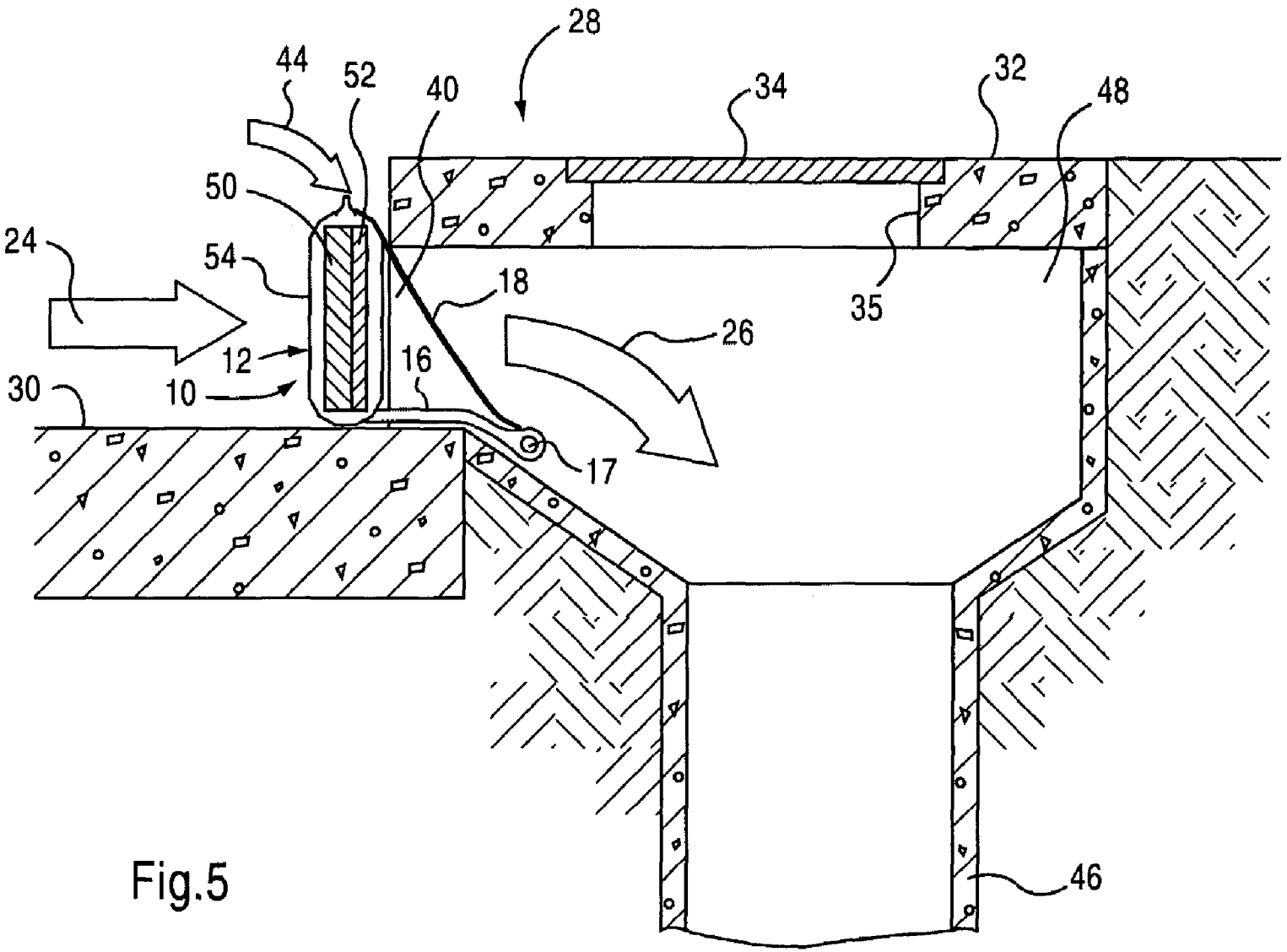
FIG. 5 is a cross-sectional view of a curb inlet and storm sewer drain with a curb inlet filter in position.

FIG. 4 illustrates the curb inlet filter 10 in place, in front of a curb inlet. FIG. 5 illustrates a cross-section of the curb inlet with the curb inlet filter 10 in place. In FIG. 4, filter body 12 is in place in front of curb inlet opening 40. In this illustration, tieback straps 22 extend rearwardly to the ground surface behind curb 36. The tieback straps 22 are staked into the ground by stakes 42.

FIG. 5 is a cross-section of the curb inlet 28 of FIG. 4, with the curb inlet filter 10 in place. As illustrated in FIG. 5, the structure of the curb inlet 28 includes a curb inlet housing 48 formed in the ground and adjacent to road surface 30. Curb inlet 28 has a top portion 32 formed on top of the curb inlet housing 48. An access opening 35 is formed in top cover 32 for allowing access to the curb inlet 28 for removing clogs and the like. An access cover 34 covers the access opening 35. A curb inlet opening 40 is formed for allowing stormwater to enter the curb inlet. Drain pipe 46 is formed on the lower portion of the curb inlet housing 48 for directing the stormwater down to the storm sewer.

Curb inlet filter 10 is shown in place in front of curb inlet opening 40. Filter body 12 sets on the road surface 30 with weight support 16 extending in the downstream direction into curb inlet housing 48. As illustrated in FIG. 5, weight support 16 also contains a weight 17 therein. Furthermore, support strap 18 extends from weight support 16 to an upper portion of filter body 12. Furthermore, filter body 12 includes a water permeable, substantially rigid, elongated frame 50 and an elongated filter cover 54. Frame 50 also includes a spacer 52 formed on a downstream side thereof. Because the thickness of the filter body 12 is substantially less than the width, this filter does not project very far from the curb, and thus does not extend substantially out into the road.

Figure 6:
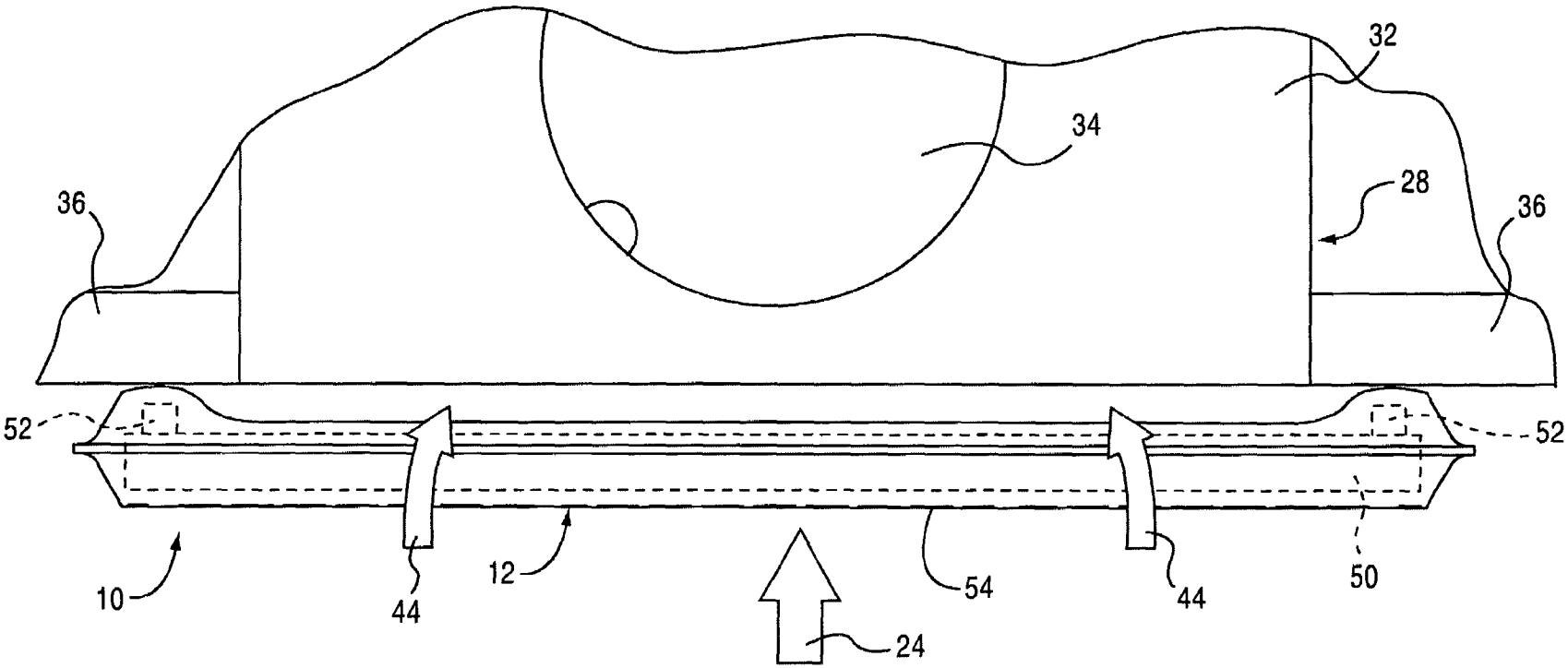
FIG. 6 is a top plan view showing a curb inlet filter in position in front of a curb inlet.

FIG. 6 is a plan view showing the curb inlet filter 10 in place against curb inlet 28. As illustrated in FIGS. 5 and 6, arrow 24 represents the inflow of stormwater. This inflow of stormwater is normally laden with suspended solids such as sediment, debris and the like. As the stormwater or sediment laden water impinges on the upstream side of curb inlet filter 10, suspended solids such as sediment and the like are trapped by the filter material of filter cover 54. The water flows through filter cover 54, and the water permeable frame 50. The outflow of water on the downstream side of the curb inlet filter 10 is represented by arrow 26. This outflow has been filtered by the curb inlet filter 10 and flows through curb inlet housing 48 into drain pipe 46 and down into the storm sewer system.

When the curb inlet filter 10 becomes clogged, or if the water level rises above the top of the curb inlet filter 10, overflow water, represented by arrows 44, flows over the top of stormwater 10 and into curb inlet opening 40. This is possible because spacers 52 space the frame 50 apart from the front of curb inlet 28. Frame 50 and spacers 52 form a gap therebetween in order to allow the overflow water to flow into opening 40 of inlet 28. The overflow capability is often specified by engineers when specifying requirements for filters for curb inlets.

Figure 7:
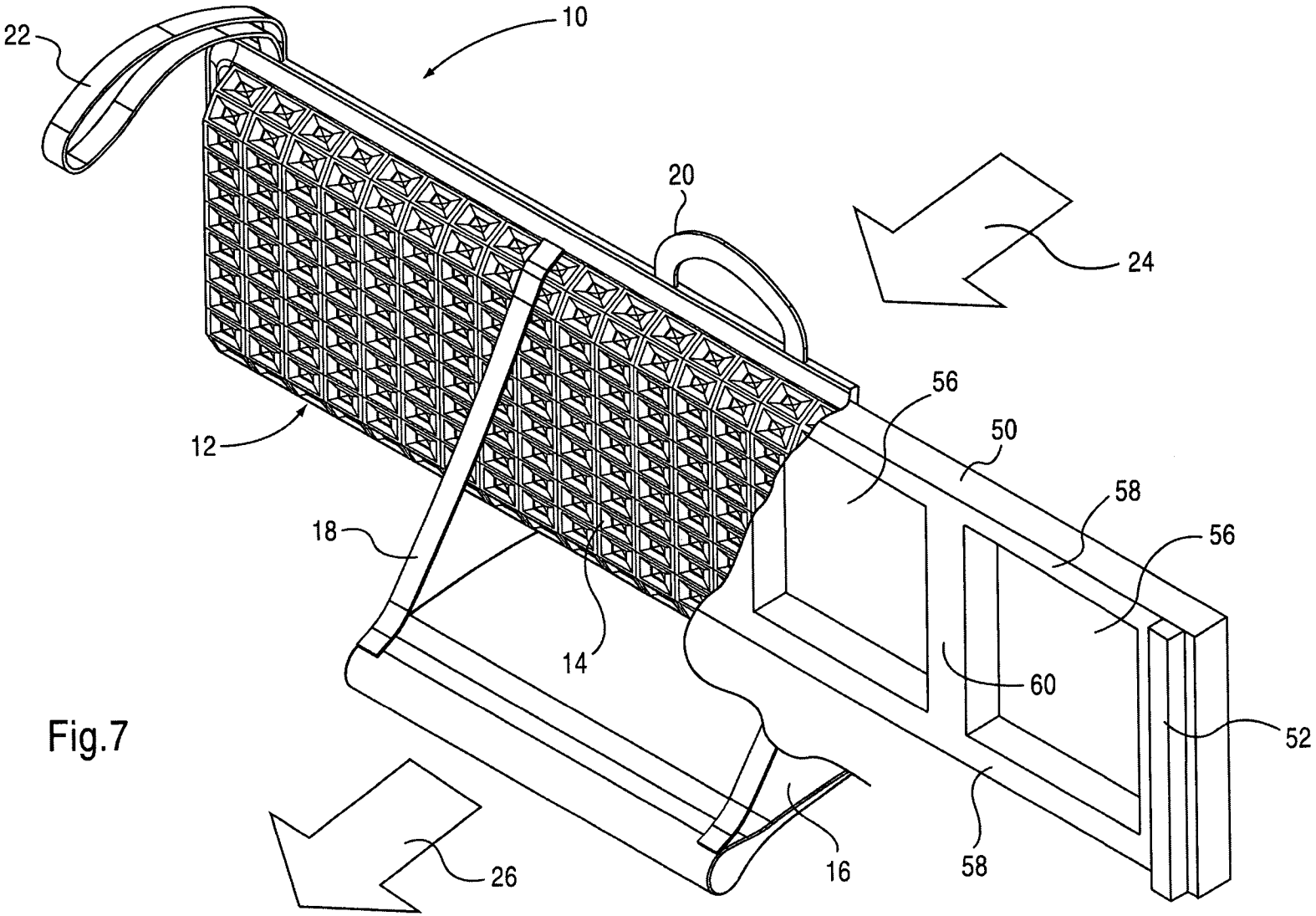
FIG. 7 is a partial cutaway view of a curb inlet filter showing the frame thereof.

FIG. 7 illustrates a partial cutaway view of the curb inlet filter 10. As illustrated, filter body 12 includes a frame 50. The frame 50 is a water permeable, substantially rigid, elongated structure. A spacer 52 is formed near an end thereof on a downstream side thereof. As illustrated in FIG. 7, the frame is made of elongated rails 58 connected together by cross members 60. This forms openings 56 which allow water to flow therethrough. It should be noted that the frame 50 disclosed in FIG. 7 is only one example of such a frame. Frame 50 may be made of plastic, metal, wood, recycled material or any other suitable material that provides the necessary water permeability, and the rigidity necessary to support the filter cover 14. It is even possible that the frame may be made of a substance such as coconut mat, so long as it has sufficient rigidity and water permeability. Frame 50 is formed as an elongated structure, and generally has a long and thin shape. The shape may be board like so that it does not take up a great deal of space in front of the curb inlet.

Filter cover 14, as illustrated in FIG. 7, entirely surrounds frame 50. Although it is possible for the filter cover to be formed on only a single side of frame 50. Preferably, however, filter cover 14 entirely surrounds frame 50.

While filter cover 14 is preferably formed by a fabric, it may also be formed by a grill or grating. Preferably though, a fabric is used for the filter cover. The fabric may be a woven fabric, a non-woven fabric, or another type of non-woven material. It is also preferable to use a multidimensional, woven fabric such as a three dimensional fabric, as illustrated in FIG. 7. A three dimensional fabric used as a filter cover is found to be efficient in filtering out solids, such as sediment and the like. Because a three dimensional fabric has a greater surface area than a two dimensional fabric, more sediment may be filtered out of the stormwater flowing through the filter.

Figures 8A, 8B:
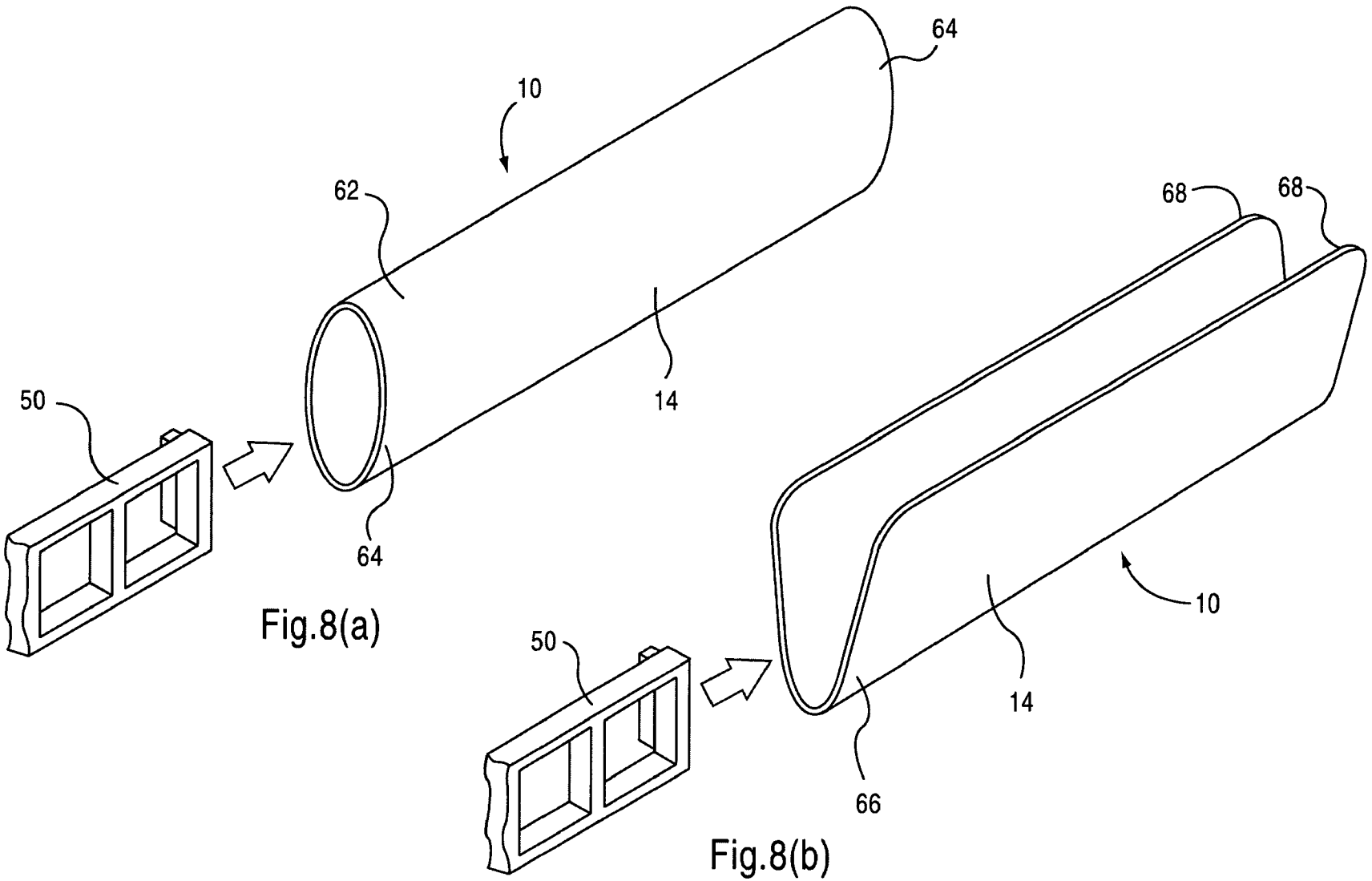
FIGS. 8(*a*)-8(*b*) illustrate insertion of the frame into filter covers.

FIGS. 8A and 8B illustrate different forms of filter covers 14. In FIG. 8A, filter cover 14 is formed of a tubular shape of fabric 62. In assembling curb inlet filter 10 in FIG. 8A, frame 50 is inserted into tubular fabric 62 and ends 64, 64 are closed. FIG. 8B illustrates an alternate version of how curb inlet filter 10 is assembled. Flat fabric 66 is provided with seams 68 along the edges thereof. For assembly, frame 50 is positioned in the fold of fabric 66 and seams 68, 68 are closed-up by way of zipper, velcro, thread, or any other conventional way.

Figure 9:
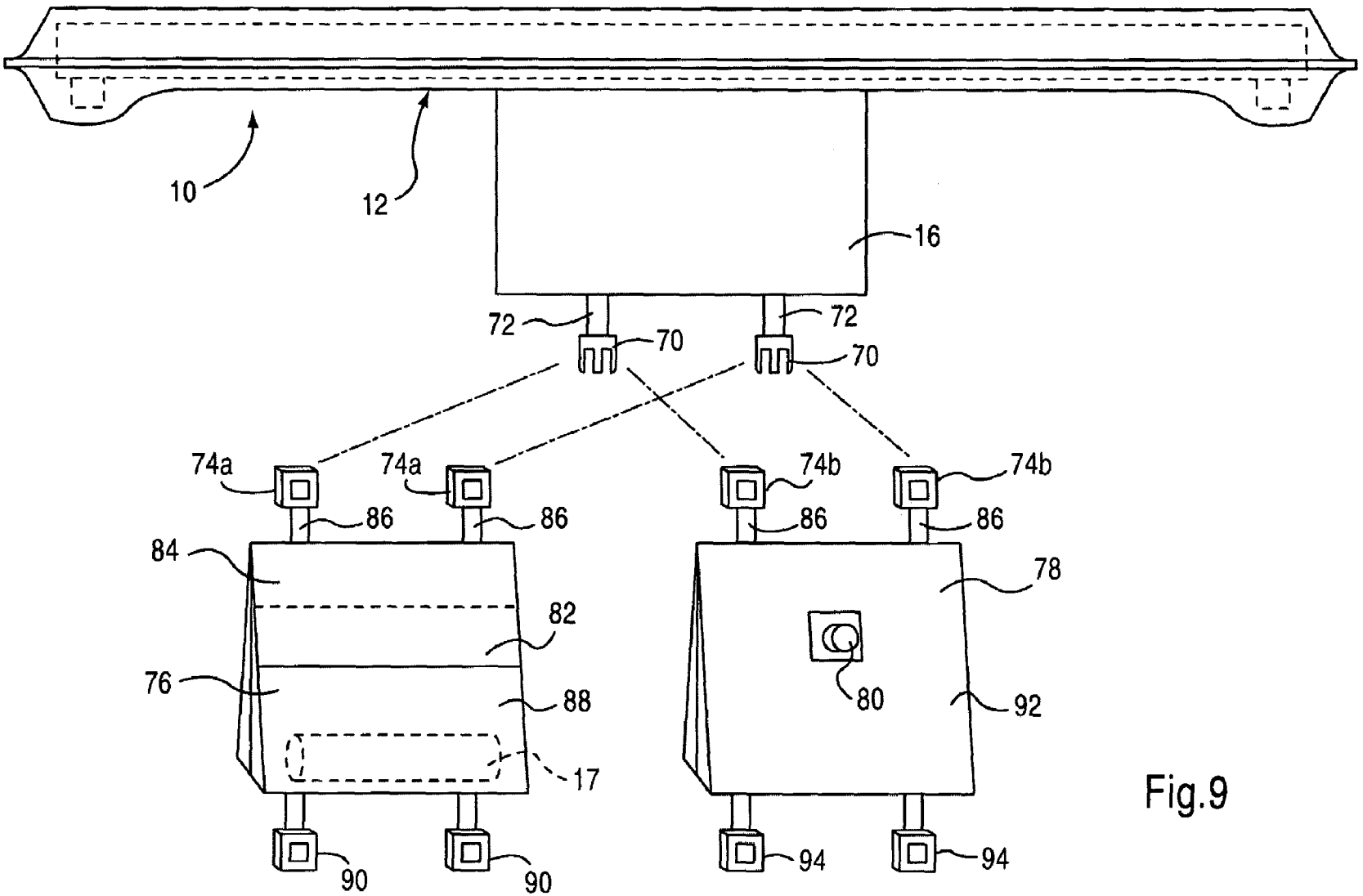
FIG. 9 illustrates different weight bags for attaching to the filter body.

FIG. 9 illustrates different weight bags for removably attaching the weight bag to the weight support of the storm filter. In FIG. 9, weight support 16 is attached to a lower portion of filter body 12 of curb inlet filter 10. Weight bags may also be considered to be part of the weight support 16. Weight bag 76 or waterproof weight bag 78 may alternately be attached to the weight support 16. The detachability of the weight bags increases adaptability and convenience for the user. For ease of attaching and detaching a weight, weight support 16, as illustrated in FIG. 9, includes male clips 70, 70, attached to weight support 16 by way of straps, 72, 72. Male clips 72, 72 are attachable with female clips 74*a*, 74*a* of weight bag 76, or female clips 74*b*, 74*b* of waterproof weight bag 78.

Weight bag 76 is attached to female clips 74*a*, 74*a* by way of straps 86, 86. Weight bag 76 includes a front flap 82 folded over front panel 88 and secured on the edges. Accordingly, this allows a weight such as weight 17 to be inserted under front flap 82 and behind front panel 88 and thus to securely remain there in order to serve as a weight for curb inlet filter 10. Weight 17 may be a steel bar, or any other suitable material for weighing down the stormwater filer. Weight bag 76 may also be part of weight support 16, since weight bag 76 also supports weight 17. Additional clips 90, 90 are attached to a lower portion of weight bag 6 in order to connect with cooperative male clips (not shown) attached to support straps 18.

Waterproof weight bag 78, as illustrated in FIG. 9, also attaches to weight support 16 by way of female clips 74*b*, 74*b* cooperatively engaging male clips 70, 70. Female clip 74*b*, 74*b* are attached to waterproof weight bag 78 by way of straps 86, 86. A closeable filling hole 80 is formed in a front panel 92 of waterproof weight bag 78. Closeable filling hole 80 may have a screw top or any other type of closable filling hole suitable for enabling waterproof bag 78 to be filled with water, and then closed-up, in order to provide the sufficient weight for curb inlet filter 10. As with weight bag 76, waterproof weight bag 78 may be part of weight support 16, since waterproof weight bag 78 supports the water therein for providing weight to hold the curb inlet filter 10 in place. Also, waterproof weight bag 78 may include female clips 94, 94 to cooperatively engage with male clips (not shown) of support straps 18. While clips are illustrated in FIG. 9, any suitable type of connecting device may be employed to connect a bag to the weight support 16.

Figure 10A:
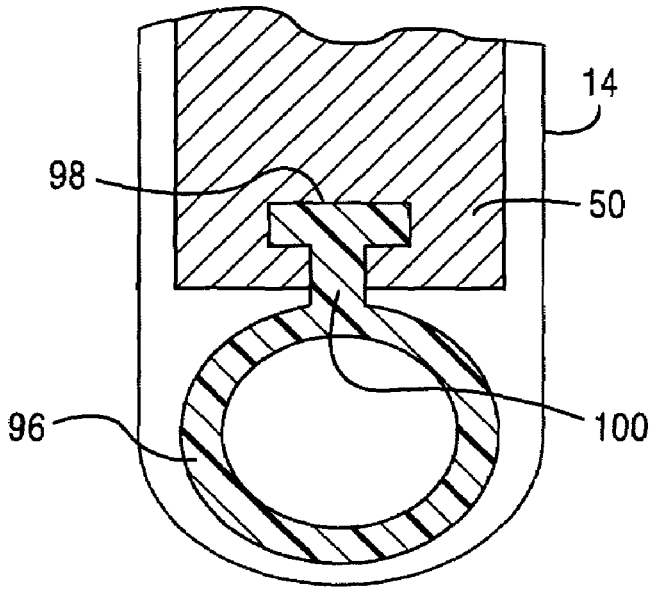
FIGS. 10(*a*) and 10(*b*) illustrate flexible inserts usable with the curb inlet filter.
Figure 10B:
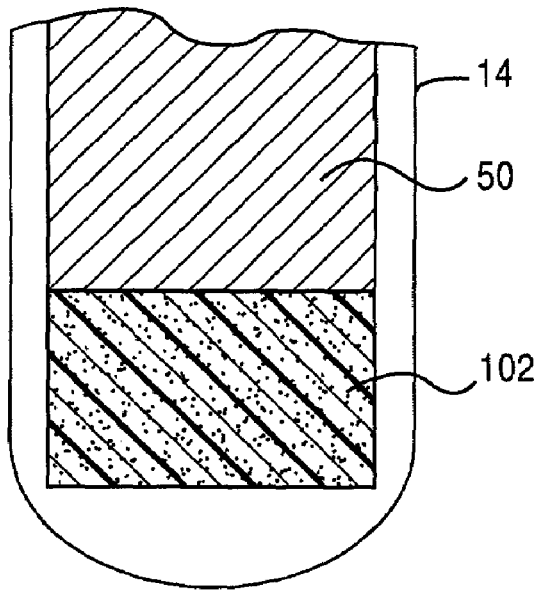

FIGS. 10(*a*) and 10(*b*) illustrate flexible inserts used with the curb inlet filter 10. Specifically, FIG. 10(*a*) illustrates a flexible extruded rubber insert 96 attached to a lower portion of frame 50 by way of a slot 98 formed in the bottom of the frame 50. A projection 100 formed axially along the length of extruded rubber insert 96 is engaged with slot 98 of frame 50 for securing the extruded rubber insert 96 to the bottom thereof. While it is preferable that extruded rubber insert 96 is located within filter cover 14, other arrangements are also possible.

FIG. 10(*b*) illustrates another version of the flexible insert. In FIG. 10(*b*), a foam portion 102 is fixed to a lower part of frame 50. Form portion 102 is affixed to the bottom of frame 50 by adhesives or any other appropriate method. As with extruded rubber insert 96, foam portion 102 is preferably formed on the bottom of frame 50, inside of filter cover 14.

Figure 11:
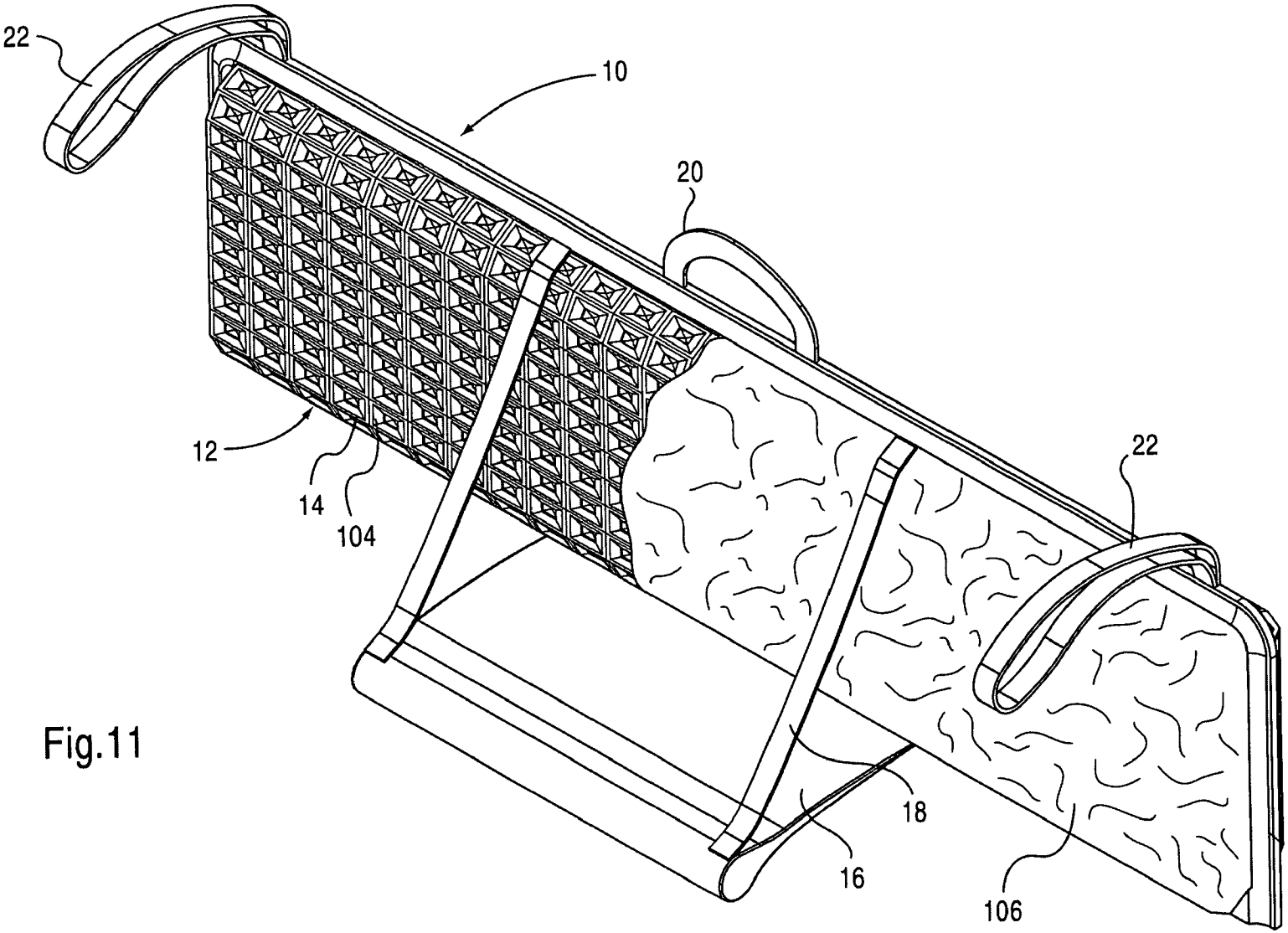
FIG. 11 is an illustration of the curb inlet filter, demonstrating woven and non-woven fabrics thereon.

FIG. 11 illustrates two type of fabrics used for filter cover 14 of filter body 12. Filter cover 14 is split into two different types of covers for illustration purposes only. On the left side of FIG. 11, a woven fabric 104 is illustrated, while a non-woven fabric 106 is illustrated on the right side of FIG. 11. Woven fabric 104 is illustrated as a multidimensional fabric. Specifically, woven fabric 104 is a three dimensional fabric. While a two dimensional fabric may be used for filter cover 14, a three dimensional fabric is preferable because it presents a larger surface area to filter the sediment laden stormwater. With a greater surface area, the three dimensional woven fabric takes longer to clog up than a similar two dimensional fabric. Non-woven fabric 106 may be a water permeable matt fabric. A perforated sheet may also be used as a filter cover.

Figure 12:
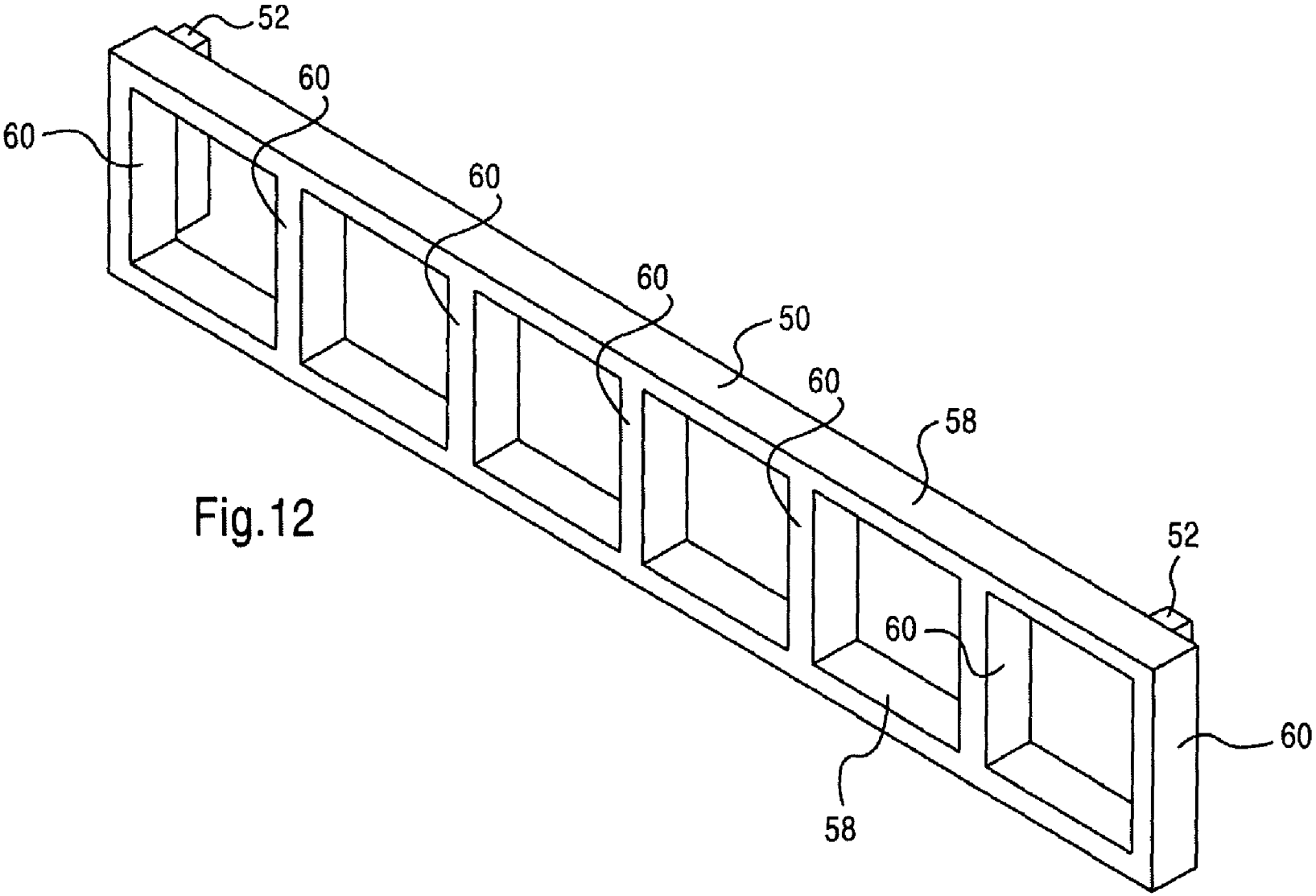
FIG. 12 is a perspective view of a single frame structure.

FIG. 12 illustrates a single frame structure with elongated frame 50 having spacers 52 formed on the downstream side thereof, one each positioned at opposite ends thereof. As illustrated, frame 50 contains generally parallel rails 58 which are connected together by cross members 60. Frame 50 provides substantial rigidity and is water permeable, so that the substantially rigid frame supports filter cover 14 and allows water to pass therethrough.

Figures 13, 14:
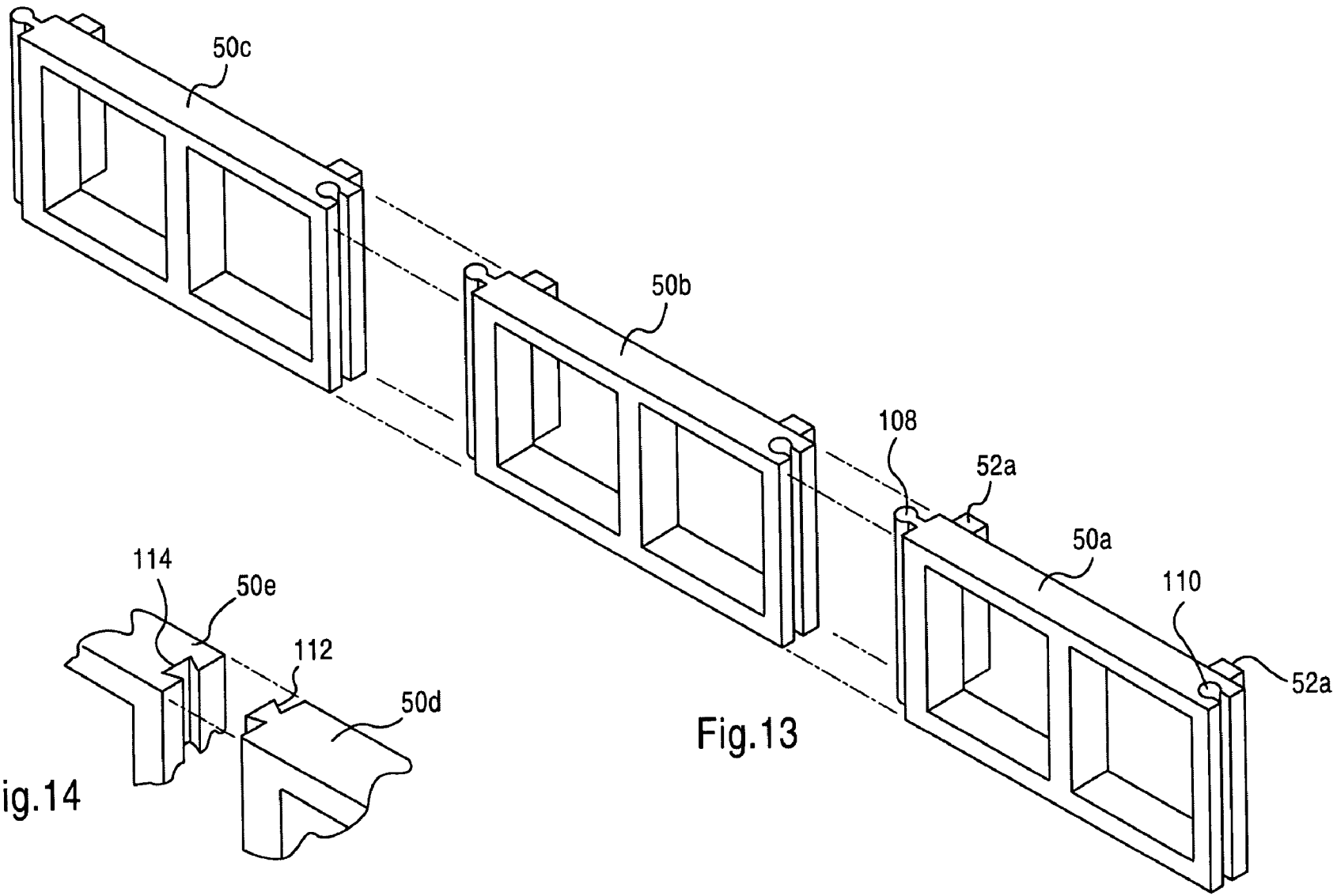
FIG. 13 is an illustration of a plurality of individual elements which make up a single elongated frame.
FIG. 14 is an illustration of dovetail type connectors between individual elements.

FIG. 13 is an illustration of a plurality of individual elements which make up a single elongated frame. In FIG. 13, frame portions 50*a*, 50*b* and 50*c* can be detachably attached to one another. In FIG. 13, each individual frame element has a male and female connector. For example, frame element 50*a* has a male connector projection 108 and a female connector recess 110. Furthermore, each individual frame element 50*a* may be supplied with individual spacers 52*a*, 52*a* on a downstream side thereof. Thus, frames of different length may be assembled by connecting individual frame elements together. While any number of individual frame elements may be combined to result in a desired length frame, individual elements are often easier and less expensive to ship.

FIG. 14 illustrates a different style of connector compared with male and female connectors 108, 110 of FIG. 13. In FIG. 14, a male dovetail projection 112 is formed on an end of frame element 50*d*. Male dovetail projection 112 enables frame element 50*d* to be attached to frame element 50*e* by being coupled with female dovetail recess 114. Additionally, individual frame elements may be detachably attached to one another by screwing individual elements together.

Although a specific form of embodiment of the instant invention has been described above and illustrated in the accompanying drawings in order to be more clearly understood, the above description is made by way of example and not as a limitation to the scope of the instant invention. It is contemplated that various modifications apparent to one of ordinary skill in the art could be made without departing from the scope of the invention which is to be determined by the following claims.

We claim:

1. A curb inlet filter for filtering out sediments, debris or the like flowing into a curb inlet, comprising:

a filter body, including (a) a water permeable, substantially rigid, elongated frame having an upstream side, facing away from the curb, and a downstream side thereof, facing toward the curb and curb inlet, (b) an elongated filter cover formed around at least one of said sides of said frame, said filter cover being formed of a filtration material to filter out sediments, debris or the like;

a weight support attached to a bottom of said filter body for supporting a weight; and a support strap connecting said weight support to an upper portion of said filter body.

2. The curb inlet filter of claim 1, wherein said frame includes a plurality of spacers, at least one each disposed at opposing ends of said frame and on said downstream side thereof, such that overflow water may flow into a gap formed between said spacers and said downstream side of said frame.

3. The curb inlet filter of claim 1, wherein said filter cover entirely surrounds said frame.

4. The curb inlet filter of claim 3, wherein said filter cover is a cylindrical sleeve, in which said frame is disposed, said sleeve being closed on opposing ends thereof.

5. The curb inlet filter of claim 3, wherein said filter cover has a closable seam along a longitudinal side thereof for retaining said frame therein.

6. The curb inlet filter of claim 1, wherein said filter cover is a woven fabric.

7. The curb inlet filter of claim 6, wherein said woven fabric is a multidimensional fabric.

8. The curb inlet filter of claim 7, wherein said multidimensional fabric is a 3 dimensional fabric.

9. The curb inlet filter of claim 1, wherein said filter cover is a non-woven material.

10. The curb inlet filter of claim 1, wherein said weight support is removably attached to the bottom of said filter body.

11. The curb inlet filter of claim 10, wherein said weight support is removably attached to the bottom of said filter body by a plurality of connectors.

12. The curb inlet filter of claim 1, wherein said weight support is a bag for receiving a weight therein.

13. The curb inlet filter of claim 12, wherein said bag is water proof and has a closable filling hole, for retaining water therein.

14. The curb inlet filter of claim 1, wherein said frame includes a plurality of individual elements which are detachably attached to one another.

15. The curb inlet filter of claim 14, wherein each of said individual elements includes one or more spacers, each spacer formed on a downstream side of one of said individual elements.

16. The curb inlet filter of claim 1, further comprising a flexible insert formed on a bottom portion of said frame, in order to adjust to a contour of road surfaces.

17. The curb inlet filter of claim 16, wherein said flexible insert is foam.

18. The curb inlet filter of claim 16, wherein said flexible insert is formed of extruded rubber.

19. The curb inlet filter of claim 1, further comprising a handle formed on an upper portion thereof.

20. The curb inlet filter of claim 1, further comprising tie back straps formed on an upper portion of said filter body.

21. A curb inlet filter for filtering out sediments, debris or the like flowing into a curb inlet, comprising:

a filter body, including (a) a water permeable, substantially rigid, elongated frame having an upstream side, facing away from the curb, and a downstream side thereof, facing toward the curb and curb inlet, and (b) an elongated filter cover formed around at least one of said sides of said frame, said filter cover being formed of a filtration material to filter out sediments, debris or the like; and a weight support attached to a bottom portion of said filter body, and extending on the downstream side thereof, for supporting a weight, for fixing the filter body against an upstream side of the curb inlet.

* * * * *